US007252627B2

(12) United States Patent
Carter

(10) Patent No.: US 7,252,627 B2
(45) Date of Patent: Aug. 7, 2007

(54) THERAPY WEIGHT SYSTEM

(75) Inventor: Kenneth Carter, Clermont, CA (US)

(73) Assignee: Tuffstuff Fitness Equipment, Inc., Pomona, CA (US)

( * ) Notice: Subject to any disclaimer, the term of this patent is extended or adjusted under 35 U.S.C. 154(b) by 591 days.

(21) Appl. No.: 10/776,098

(22) Filed: Feb. 10, 2004

(65) Prior Publication Data

US 2005/0176559 A1 Aug. 11, 2005

(51) Int. Cl.
*A63B 21/062* (2006.01)
*A63B 21/078* (2006.01)

(52) U.S. Cl. ..... 482/98; 482/94

(58) Field of Classification Search ..... 482/93–101, 482/135–136, 138–142
See application file for complete search history.

(56) References Cited

U.S. PATENT DOCUMENTS

| | | | | |
|---|---|---|---|---|
| 4,610,449 | A | 9/1986 | Diercks, Jr. | 272/118 |
| 4,746,113 | A | 5/1988 | Kissel | 272/118 |
| 5,350,344 | A * | 9/1994 | Kissel | 482/98 |
| 5,776,040 | A * | 7/1998 | Webb et al. | 482/98 |
| 5,876,313 | A * | 3/1999 | Krull | 482/98 |
| 6,033,350 | A * | 3/2000 | Krull | 482/98 |
| 6,186,927 | B1 | 2/2001 | Krull | 482/98 |
| 6,387,019 | B1 * | 5/2002 | Krull | 482/98 |
| 6,422,979 | B1 | 7/2002 | Krull | 482/98 |
| 6,629,910 | B1 | 10/2003 | Krull | 482/98 |
| 6,666,800 | B2 * | 12/2003 | Krull | 482/94 |
| 6,902,516 | B2 * | 6/2005 | Krull | 482/98 |
| 2002/0025888 | A1 * | 2/2002 | Germanton et al. | 482/1 |
| 2002/0055426 | A1 | 5/2002 | Krull | 482/98 |
| 2003/0092542 | A1 | 5/2003 | Bartholomew et al. | 482/99 |
| 2003/0199368 | A1 | 10/2003 | Krull | 482/106 |

FOREIGN PATENT DOCUMENTS

| | | |
|---|---|---|
| WO | WO 97/41927 | 11/1997 |

* cited by examiner

*Primary Examiner*—Fenn C. Mathew
(74) *Attorney, Agent, or Firm*—Cislo & Thomas LLP

(57) ABSTRACT

An incremental weight system enables increments of a certain standard weight size to provide selectable resistance. A selector plate having radially-displaced pins correspond to radially-displaced slots in incremental weights. The selector plate is spring biased to engage or be urged toward the incremental weights. The spring biasing may be overcome by manual effort working against the spring to remove a handle's distal end or other locking mechanism from a positioning hole or otherwise. An amount of incremental weight can then be selected with the appropriate pin engaging the corresponding slot in one of the incremental weights. An easy means is then provided by which an incremental weight can be selectably added to selector weight stacks and the like.

9 Claims, 8 Drawing Sheets

THERAPY WEIGHT SYSTEM

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to selector weight systems and more specifically to an incremental weight system that allows the addition of resistant weights in between those already available in a selector weight system.

2. Description of the Related Art

Prior attempts have been made in the art with respect to incremental weight systems for use in physical therapy, sports training, and otherwise. Generally, these incremental weight systems are used to provide additional resistant weight in increments that are smaller than those that are generally available in standard selector weight systems.

There are numerous selector weight systems in use today on the myriad of exercise machines that are sold on the market from any of a number of companies that manufacture exercise equipment. The primary function of a selector weight stack, as it is most commonly referred to, is to provide the user of an exercise machine with a convenient way of selecting weight resistance for exercising in increments of 10, 15, or 20 pounds. Although there are many weight stack styles and types used by the various companies, the most common weight stack in use today is comprised of nineteen 10 pound weights, for a total of 200 pounds, and will allow the user to select, by means of a selector pin, any variation in weight increments from 10 pounds to 200 pounds. Some weight stacks that are comprised of 15 pound weights, or even 20 pound weights and may provide maximum resistance levels of perhaps 300 or 400 pounds.

The resistance provided by these weight stacks (that is, selectable in 10, 15, or 20 pounds increments) is satisfactory for most applications by the average exercise machine user and may even be desirable in some cases for exercise equipment designed for body building purposes. However, in many exercise equipment applications such as equipment used by elderly people, disabled people, or people being treated for injuries by a physical therapist, much smaller weight resistance increments are needed. It has been determined that selective weight resistance increments of 2½ pounds are preferred by the majority of physical therapists and sports medicine clinics.

Obviously, if a weight stack were comprised of only 2½ pounds weights, the weight stack, if it were to offer at least 100 pounds of resistance, would be very narrow and unusually tall. In fact, a weight stack design such as this could be used for little else and would not be practical for use on the average exercise machine. Prior attempts in the art include a number of attempts to provide a different weight system apparatus, although, not necessarily those that would allow incremental or intermediary values between a certain selected weight in a selector weight system. Additionally, many of these prior art attempts do not allow retrofitting of current selector weight systems in order to provide easy modification of existing selector weight stacks. In other attempts, side weights or collateral weights are engaged by pins or the like in a manner that far exceeds the needs for an incremental weights system.

As a result, the art would be improved by providing a therapy or other incremental weight system that was easily retrofitable to existing systems as well as providing only the weights needed in order to provide the incremental weight steps between discreet weight plates in existing selector weight stack systems.

SUMMARY OF THE INVENTION

In view of the foregoing disadvantages inherent in the known types of incremental weight systems now present in the prior art, the present invention provides an incremental weight system that is easily retrofittable wherein the same can be used for providing incremental weights for resistance training and the like.

The general purpose of the present invention, which will be described subsequently in greater detail, is to provide a new incremental weight system that is particularly adapted to therapeutic or sports training uses, the incremental weight system having many of the advantages of weight systems mentioned heretofore many novel features that result in a new incremental weight system which is not anticipated, rendered obvious, suggested, taught, or even implied by any of the prior art incremental weight systems for other weight systems, either alone or in any combination thereof.

Provided herein is a system or a device by which two or more supplemental weights may be added to a standard selector weight stack and are fixed so that they may be incrementally selected to work with any desired weight selection available on the weight stack. For example, a therapist or trainer may wish to use 20 pounds for a given exercise in order to train a client, then increase the resistance by an additional 2½ pounds, then an additional 5 pounds, etc.

The device set forth herein accomplishes the selectivity features that are described above. It is different from other similar devices known in the art that attempt to provide these same supplemental weight resistance features. Other systems have introduced devices that have supplemental weights that are on a separate system off to the side of the weight stack, or, must be manually selected by physically moving the supplemental weights into the desired position by means of a sliding bar, or by simply adding loose weights to the top of the selector weight stack itself.

The device provided herein is mounted upon the top plate of the selector weight stack and is designed in such a way that supplemental weights may be added in 2½ pound (or selectable other) increments. Increments are selectively added by means of the device and are lifted and used in conjunction with the weights that are selected on the weight stack. In one embodiment, the device uses a spring-loaded disk, or plate, at the rear of which three male pins have been fixed for the purpose of selecting and lifting any of the three supplemental weight plates from their docking position on the rear of the weight stack.

A dial and handle on the front of the spring-loaded disk allows the user to pull slightly against the spring tension and rotate the disk to any of four different positions. The three uppermost positions on the dial are set to correspond with the three supplemental weights. When the dial has been rotated and the handle is released into any one of the three upper marked positions, one of the three pins on the rear of the disk is then engaged with one of the supplemental weights.

In the first of the selected positions, one supplemental weight is lifted, in the second position, two supplemental weights are lifted, and in the third position, all three supplemental weights are lifted. If for any reason the dial is rotated to any position between the three marked positions and released, no supplemental weight is engaged and only the weight that has been selected on the main weight stack will be operative. Also, there is a fourth, and neutral position, marked at the bottom of the dial for the purpose of locking in the dial making it unlikely to accidentally rotate the dial and select a supplemental weight.

In one embodiment, an incremental weight system having a plurality of selectable weights has an incremental weight stack having a plurality of incremental weights with each of the incremental weights having a slot. A selector plate has a number of pins equal to the number of incremental weights with each pin uniquely corresponding to a single one of the incremental weights on a one-to-one basis so that each pin has a uniquely corresponding incremental weight and vice versa. Each of the pins is positioned on the selector plate to uniquely engage the slot of the corresponding incremental weight.

The selector plate is positioned proximate and adjacent to the incremental weights so that the pins may selectably engage the slots as the selector plate is positionable so as to selectably and uniquely engage one or more of the incremental weights.

In another embodiment, an incremental weight system has a plurality of selectable incremental weights that are supported by a stand. The incremental weight stack has a plurality of incremental weights of similar weight, with each of the incremental weights having a slot. A selector plate has a number of pins equal to the total number of incremental weights with each pin positioned to uniquely correspond to a single slot in a single one of the incremental weights on a one-to-one basis so that each pin has a uniquely corresponding incremental weight and incremental weight slot and vice versa. The selector plate is also positionable so that it does not engage the incremental weight stack with any of the pins.

The selector plate is proximate and adjacent the incremental weights so that the pins may selectably engage the slots. The selector plate is positionable so as to selectably and uniquely engage one or more of the incremental weights with a corresponding pin. The incremental weight stack is offset a generally small distance from a center of the selector plate.

Each of the slots of the incremental weights are disposed a different radial distance from the center of the selector plate with each of the pins also disposed the same different radial distance from the center of the selector plate such that by displacing and turning the selector plate, individual ones of the incremental weights may be engaged by a corresponding pin which is able to pass through a corresponding slot.

A chassis that is adapted to engage a selector weight stack provides support for the selector plate. Generally, the selector weight stack has a number of uniform weights. The incremental weight system also includes: a retaining plate; a post slidably passing through the retaining plate and coupled at a distal end to the selector plate: a biasing spring system biasing the post and the selector plate toward the incremental weight stack; and a handle coupled to the post. The chassis, the retaining plate, the post, the biasing system, and the handle together may weigh approximately the same as an individual one of the incremental weights with each of the incremental weights weighing approximately one-fourth (¼) of the weight of one of the uniform weights of the selector weight stack.

BRIEF DESCRIPTION OF THE DRAWINGS

FIG. 6 shows its handle retracted and spring compressed.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
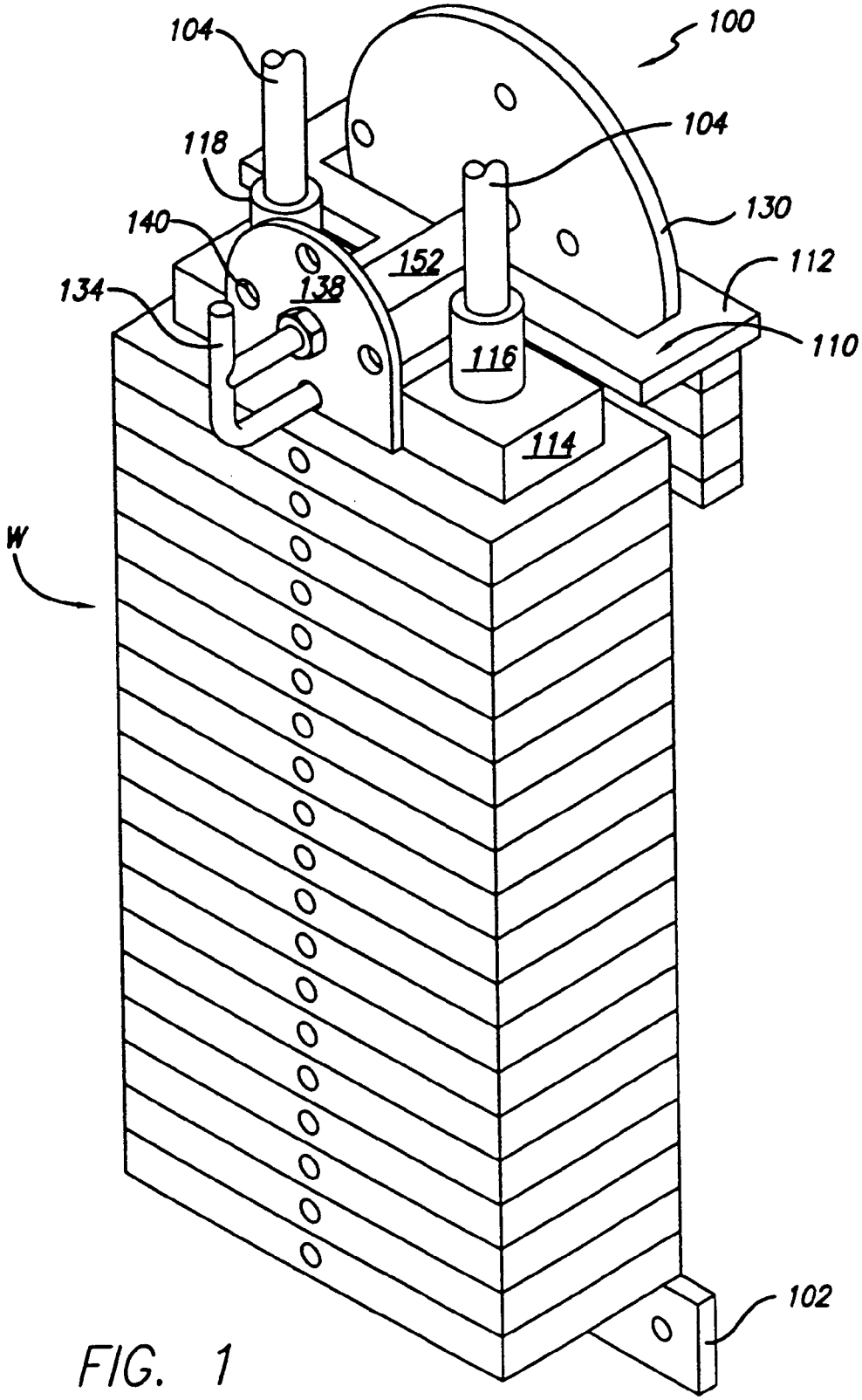
FIG. 1 is a front left upper perspective view of a selector weight system having the incremental weight system at its top with the selector plate away from the viewer and the handle closest to the viewer.

Referring to the drawings where like numerals of reference designate like elements throughout it will be noted that the incremental weight system 100 is generally used in conjunction with a selector weight system W such as that shown in FIG. 1. A base or stand 102 serves to support the incremental weights of the incremental weight system 100 and the base 102 of the stand is shown near the bottom of FIG. 1. The base is shown with bolt holes which is one of a pair of bolt holes that allows the stand to be bolted to a weight resistance system incorporating the selector weight stack W. The stand enables the incremental weights (about which more is set forth below) to be supported for engagement by the remaining components of the incremental weight system 100 and to prevent the incremental weights from being supported by the selector weight stack 100.

Figure 2:
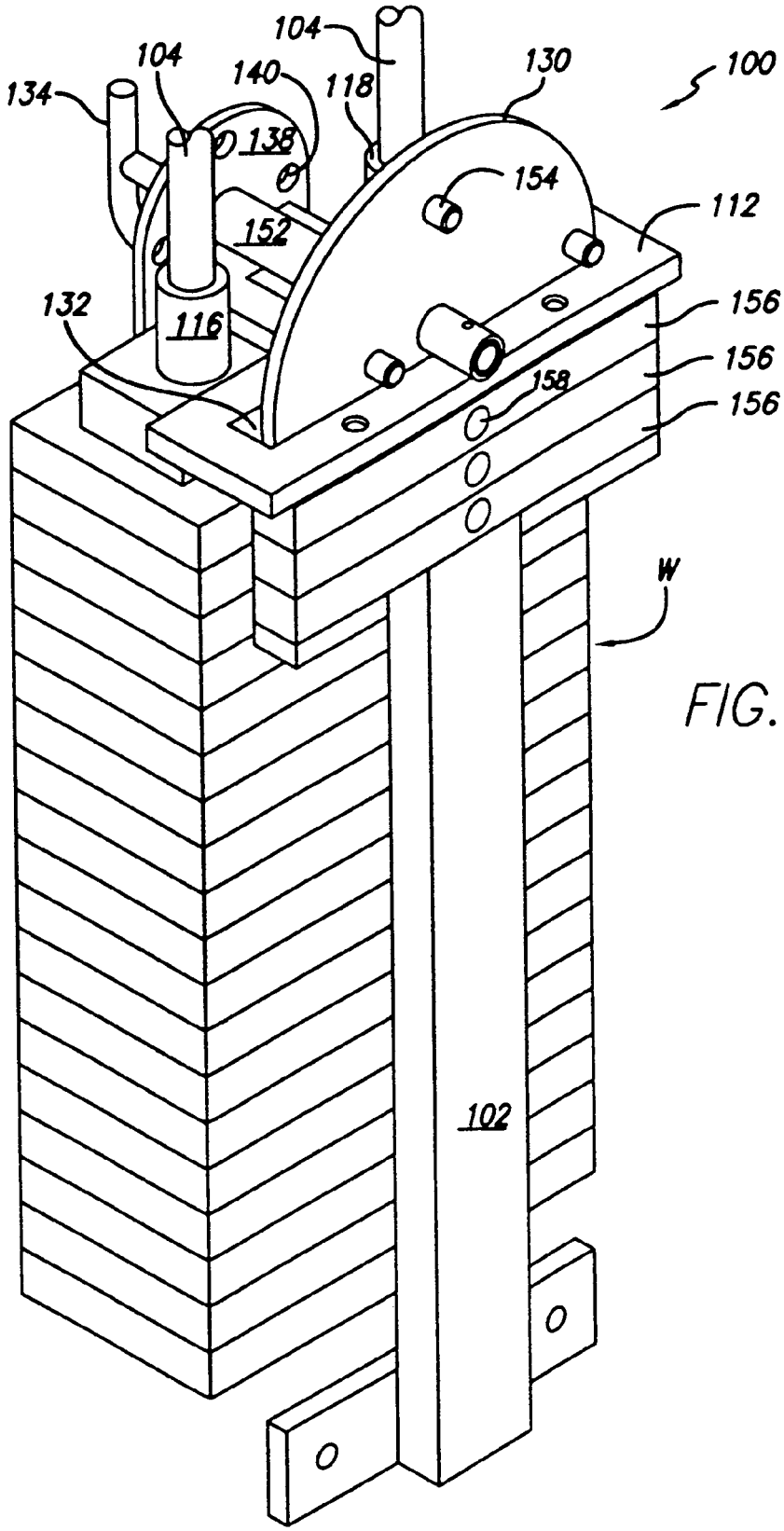
FIG. 2 is a rear left upper perspective view of the incremental weight system with the selector weight system beneath it as shown in FIG. 1.

As shown in FIGS. 1 and 2, the incremental weight system 100 generally rests upon a selector weight stack W. FIGS. 2-7 show various aspects of the incremental weight system by which its construction and operation can be readily perceived. Extending upwardly and generally traveling through both the selector weight stack W and the incremental weight system 100 are bars or rods 104 which generally keep the weights of the selector weight stack as well as the incremental weight system 100 with the selected weights traveling along the bars 104 in order to alignedly control the travel path of the incremental weight system 100 and any selected weights from the selector weight stack W.

Figure 3:
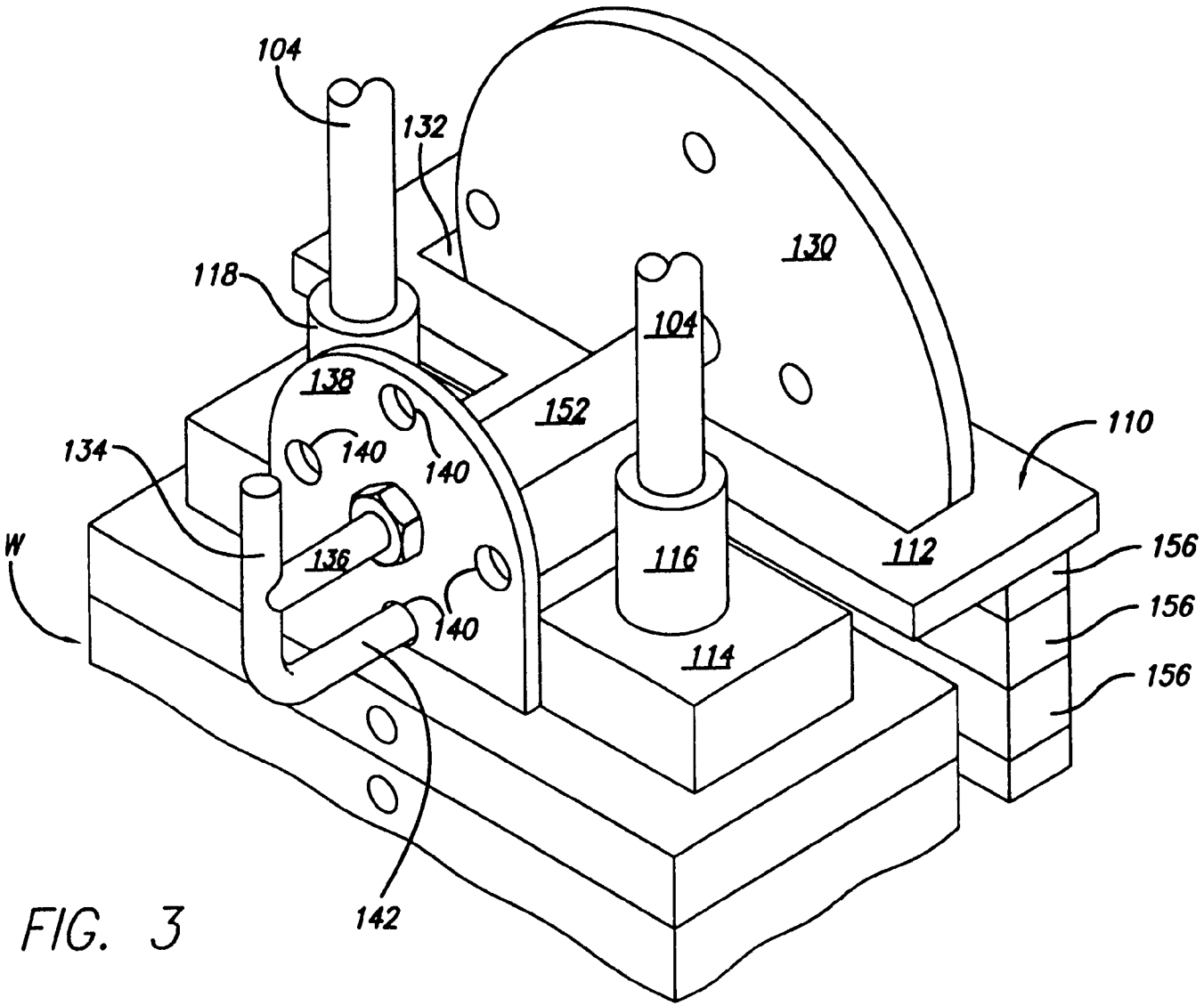
FIG. 3 is an enlarged top left perspective view of the incremental weight system of FIG. 1.

Turning now to FIG. 3, the incremental weight system 100 has a chassis 110 which includes a selector plate portion 112 and a main portion 114. The main portion 114 includes two circumscribing cylinders 116, 118 which slidably travel along the bars 104. The selector plate 130 rotates within the selector plate aperture 132 defined by the selector plate portion 112 of the chassis 110. The selector plate 130 is connected to the handle 134 by a rod or post 136 that travels from the selector plate 130 to the handle 134. The rod 136 travels through a retaining plate 138 into which may be drilled or formed a number of positioning holes 140. These holes may serve as locking mechanisms for the handle 134 as its distal end 142 is inserted into one of the four (as shown in FIG. 3) positioning holes 140.

Figure 4:
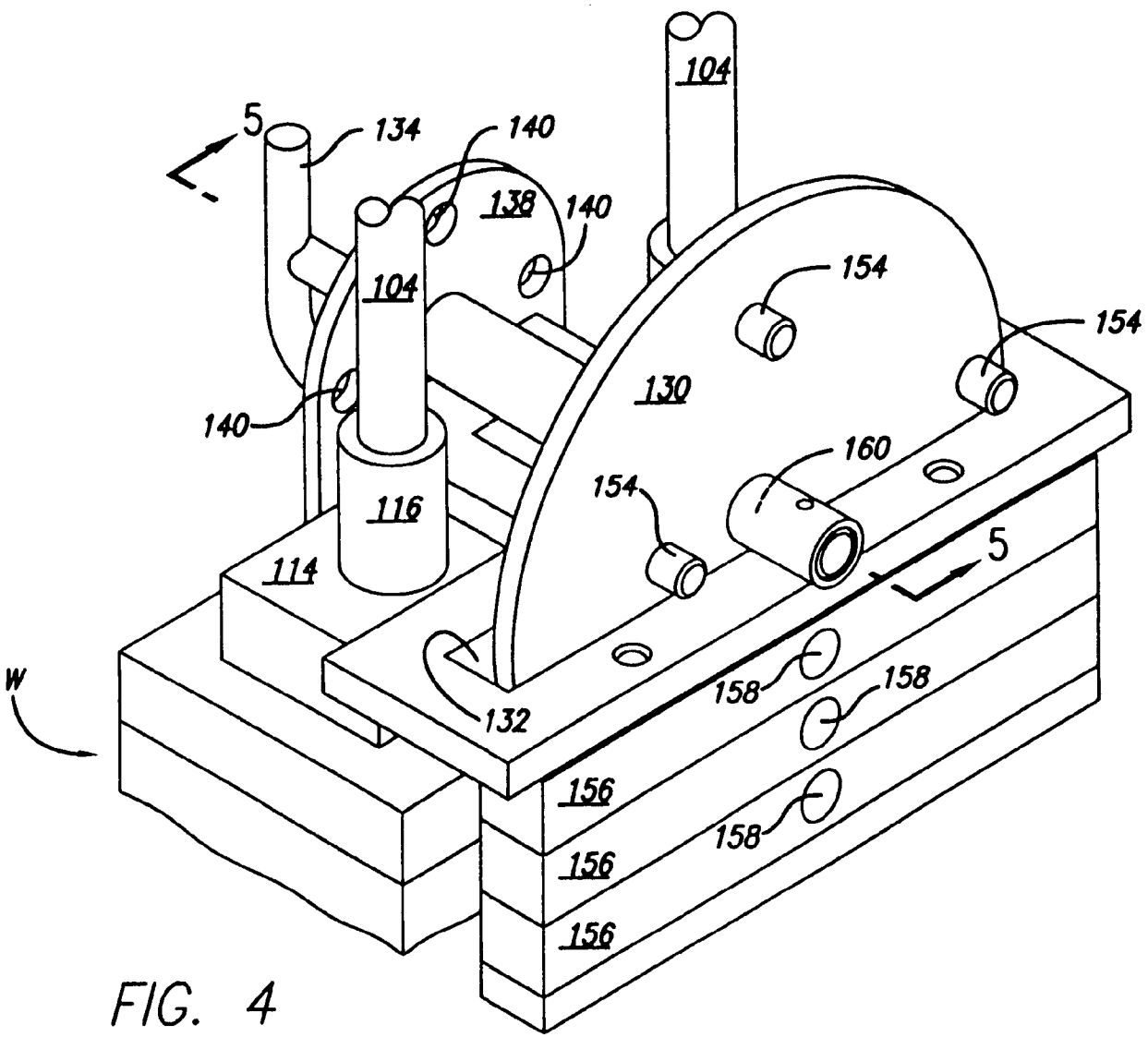
FIG. 4 is a rear top left perspective view of the incremental weight system of FIG. 2.
Figure 5:
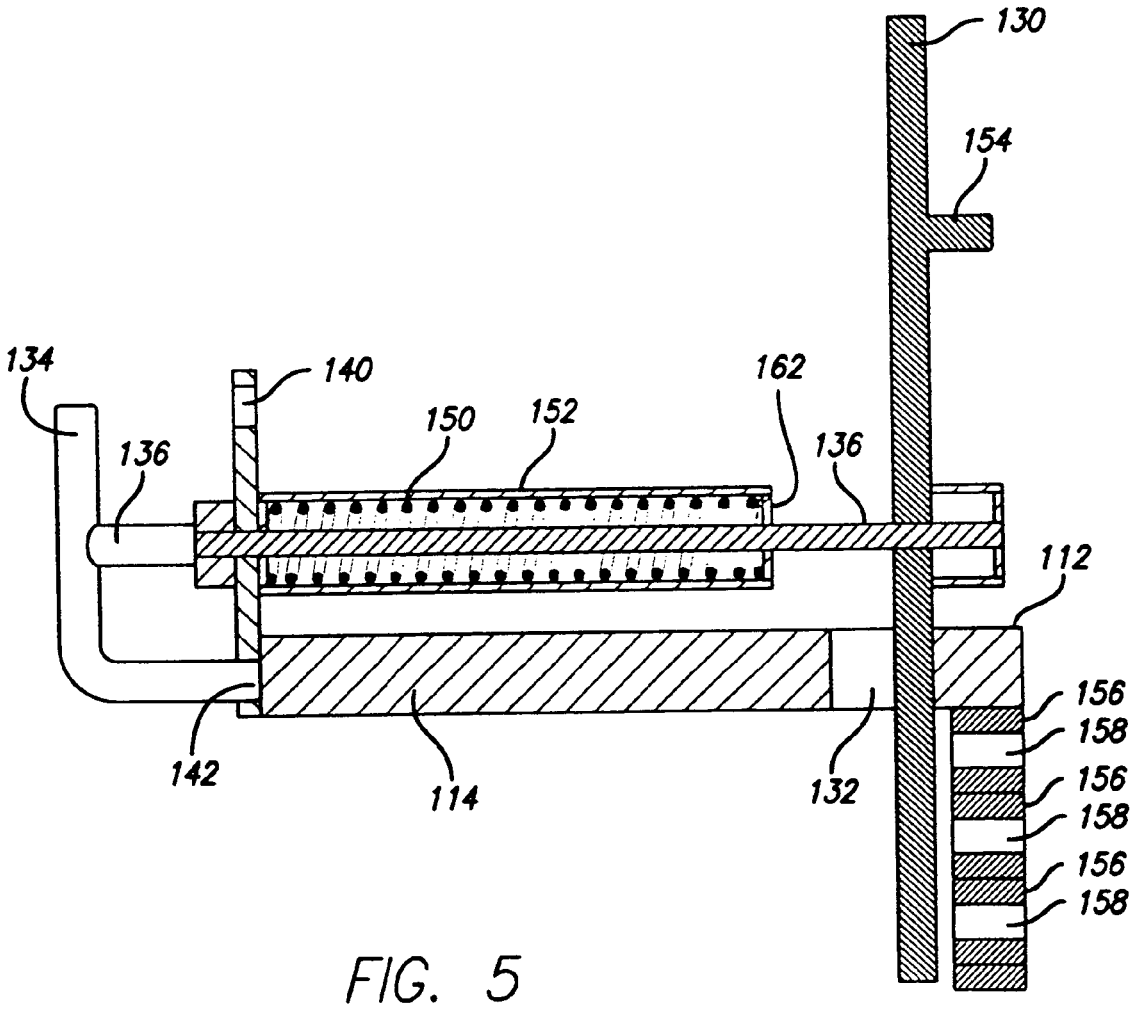
FIG. 5 is a cross sectional view of the incremental weight system of FIG. 3 taken along line 5-5.
Figure 6:
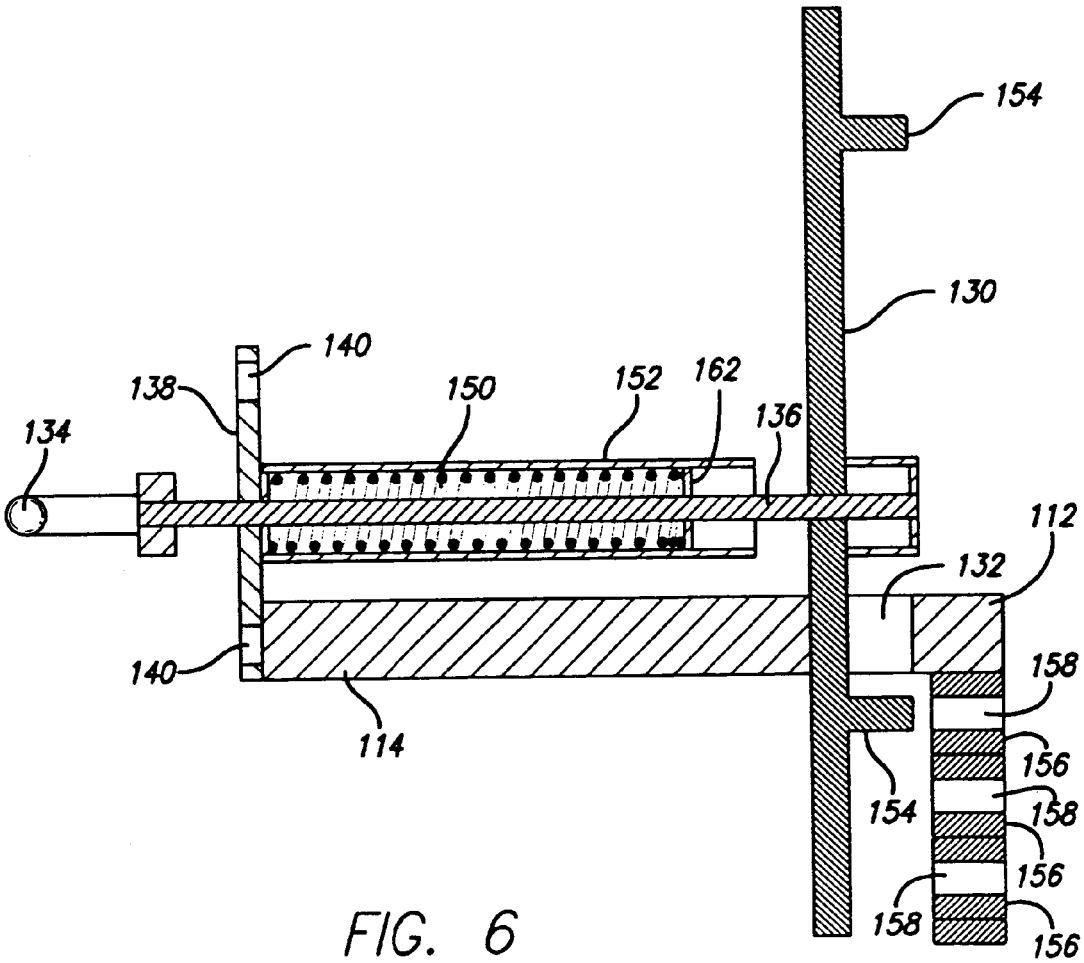
FIGS. 6, 7, and 8 are additional cross section views of the incremental weight system of FIG. 3 taken with the selector plate and handle shown in the other three positions.
Figure 7:
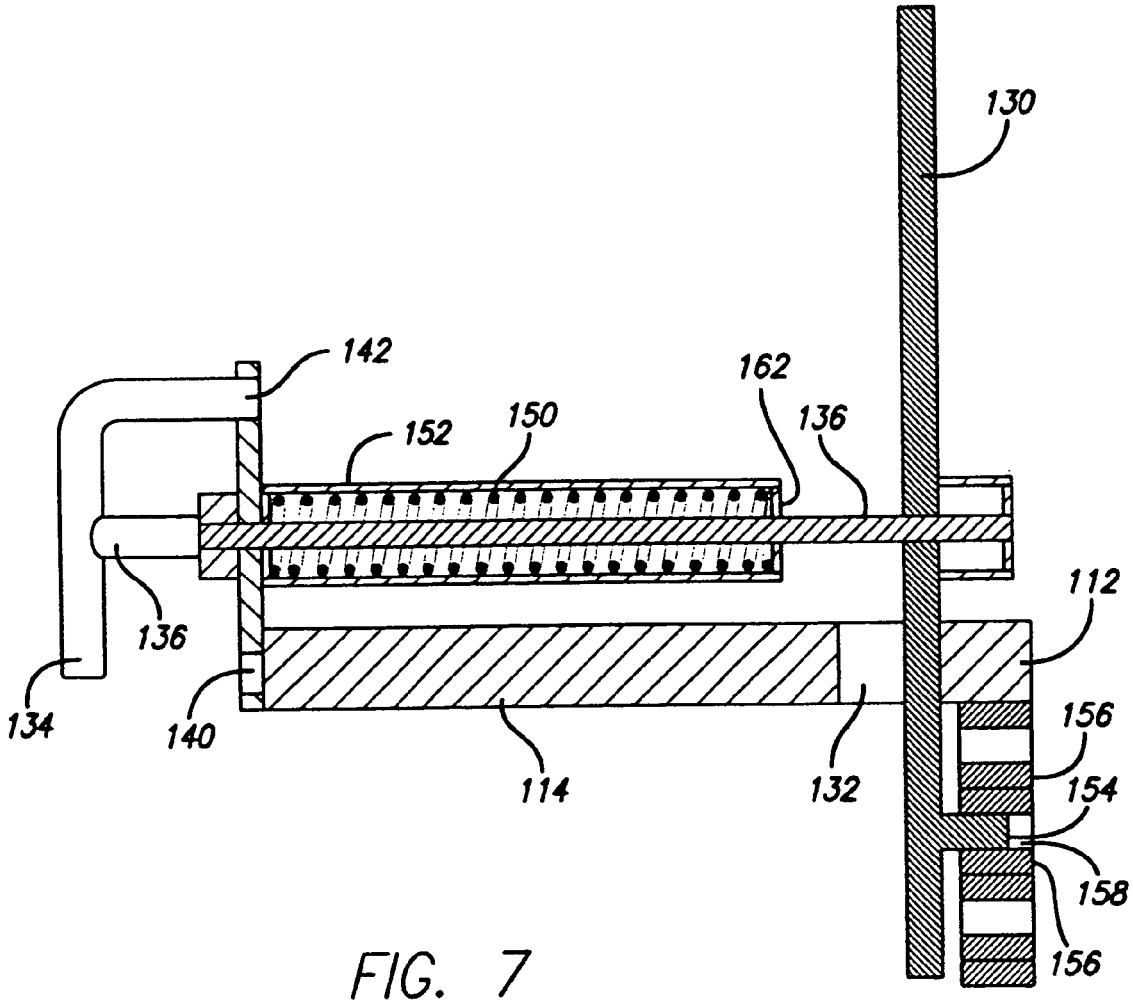
Figure 8:
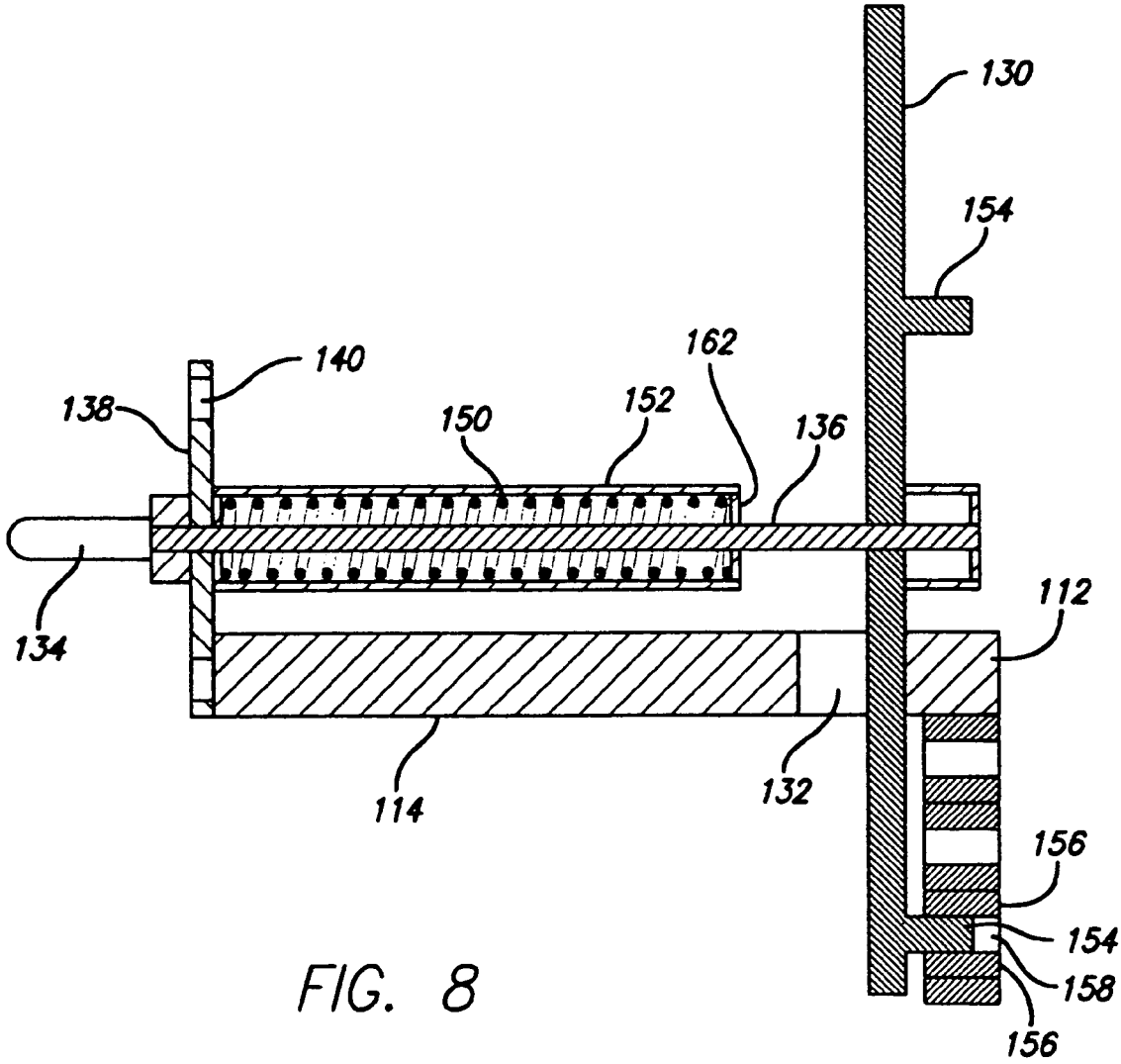

FIG. 5 shows a cross section of the incremental weight system 100 taken along line 5-5 of FIG. 4. Many of the structures mentioned above are shown in FIG. 5. However, a better view of the spring 150 with its housing 152 is provided in FIG. 5. The selector plate aperture 132 is generally wider than the width of the selector plate 130 and the length of any associated pins 154. This is to enable both restriction of backward movement of the selector plate 130 away from the incremental weights 156 but also to allow the pins 154 to engage and disengage the holes or slots 158 of the incremental weights 156. Examples of this are shown in FIGS. 6-8.

The spring 150 biases the selector plate 130 towards the incremental weights 156. The spring is held in place by compression by the slidable distal end 162 of the housing 152 and the retaining plate 138. As the spring pushes these two elements apart, the handle 134 with its distal end 142 is held in place by the selected positioning hole 140 until manually repositioned.

The biasing force of the spring 150 may be overcome by manual engagement by pulling the handle 134 away from the retaining plate 138 so that the handle's distal end 142 disengages the positioning hole 140. The handle 134, post 136, and selector plate 130 may all be turned freely once the handle's distal end 142 has disengaged the positioning hole 140 and any pin 1514 has disengaged its corresponding weight slot 158. The distal end 142 of the handle 134 may then be positioned into a different positioning hole 140. In doing so, one of the pins 154 is then generally disposed into the uniquely corresponding hole or slot 158 in the corresponding one of the incremental weights 156. This is shown in FIG. 6-8.

Upon disposing one of the pins 154 into one of the incremental weights 156, one or more of the incremental weights 156 is selected and engaged by the selector plate 130. That incremental weight 156 and any weights 156 above it are then engaged by the selector plate 130 and will travel with it as the chassis 110 is raised and lowered with the other weights of the selector weight stack W that have been selected by the exerciser.

For example, in FIG. 6, one incremental weight 156 has been selected as the pin 154 is disposed in the highest slot of the three incremental weights 156. In FIG. 7, both the upper and the middle incremental weights 156 are engaged by the selector plate 130 as the engagement of the center incremental weight 156 causes the additional upper incremental weight to travel with it for when the middle incremental weight 156 is raised the upper incremental weight 156 to travel with it. In FIG. 8, the bottom-most incremental weight 156 is selected as the corresponding pin 154 has been inserted into the bottom of slot 158. This causes both the middle and upper incremental weights 156 to travel with the bottom incremental weight 156 as the upper two weights 156 are trapped between the bottom most incremental weight 156 and the chassis and the selector plate portion 112 of the chassis 110.

In this way, additional incremental weights can be added to the resistive weight provided by the selector weight stack W. Generally, each of the selector weight stack W are uniform in weight. Each of the incremental weights 156 is generally a fraction of the weight of one of the selector weight stack weights. For example, if each of the weights in the weight stack W is ten pounds, each of the incremental weights 156 may be two and a half pounds. In one embodiment, the remaining portion of the incremental weight system 100 is as light as possible, possibly made of lightweight composite materials or otherwise so that they add little additional weight to the selector weight stack W with most of the additional weight being delivered by the incremental weights 156. Alternatively, the remaining portion of the incremental weight system 100 may weigh the same or similarly to one of the incremental weights 156 so that, for example, when no incremental weights 156 are engaged (FIG. 4), an incremental weight at the same weight as the other incremental weights 156 is provided by the chassis 110 and other structures of the incremental weight system 100.

Generally, the fraction that each incremental weight 156 is with respect to a single weight of the selector weight stack W determines how many incremental weights 156 there are. Generally, quarter units may be preferred to ensure that only one pin is able to engage an incremental weight at any one time.

It should be noted that the means by which the pins 154 are able to engage the slots 158 and the incremental weights 156 is due to the difference in radial displacement of both the slots 158 and the pins 154 with respect to the center 160 of the selector plate 130. The center of a pin 154 must be the same distance away from the center 160 of the selector plate 130 as the center of the corresponding slot 158.

In use, the incremental weight system 100 is added to a selector weight stack W in a manner suggested by FIG. 1 which shows one embodiment of the present system. The handle 134 is pulled back so as to disengage distal end 142 of the handle 134 from the current positioning hole. The desired incremental weight is then selected by inserting the handle's distal end 142 into the corresponding positioning hole 140 which may be marked readily for the convenience of the exerciser. Upon inserting the distal end 142 of the handle 134 into the desired positioning hole 140, the corresponding pin 154 is inserted into the slot 158 of the desired incremental weight 156 which causes that weight to travel with the incremental weight system 100 as well as any incremental weights 156 above it.

While the present invention has been described w ith regards to particular embodiments, it is recognized that additional variations of the present invention may be devised without departing from the inventive concept.

What is claimed is:

1. An incremental weight system having a plurality of selectable weights, comprising:

an incremental weight stack having a plurality of incremental weights, each of said incremental weights defining a slot;

a selector plate having a number of pins equal to a total number of said incremental weights with each pin uniquely corresponding to a single one of said plurality of incremental weights on a one-to-one basis so that each pin has a uniquely corresponding incremental weight and vice versa, each of said pins positioned on said selector plate to uniquely engage said slot of said corresponding incremental weight, said selector plate being proximate and adjacent said incremental weights so that said pins may selectably engage said slots and said selector plate being positionable so as to selectably and uniquely engage one or more of said incremental weights, wherein said incremental weight stack offsets a radial distance from a center of said selector plate, wherein each of said slots of said incremental weights is disposed at a different radial distance from said center of said selector plate, wherein each of said pins is disposed at a different radial distance from said center of said selector plate, and whereby displacing and turning said selector plate, individual ones of said incremental weights are engageable by a corresponding pin which is passable through a corresponding slot.

2. An incremental weight system having a plurality of selectable weights as set forth in claim 1, further comprising:

a chassis adapted to engage a selector weight stack;

a retaining plate;

a post slidably passing through said retaining plate and coupled at a distal end to said selector plate;

a biasing system biasing said post and said selector plate toward said incremental weight stack; and a handle coupled to the post.

3. An incremental weight system having a plurality of selectable weights as set forth in claim 1, wherein said biasing system further comprises a spring.

4. An incremental weight system having a plurality of selectable weights as set forth in claim 1, wherein said selector weight stack has a number of uniform weights;

wherein each of said incremental weights of said incremental weight stack weighs approximately the same; and wherein said chassis, said retaining plate, said post, said biasing system, and said handle weigh approximately the same as an individual one of said incremental weights.

5. An incremental weight system having a plurality of selectable weights as set forth in claim 4, wherein each of said incremental weights is approximately one-fourth (¼) the weight of one of said uniform weights of said selector weight stack.

6. An incremental weight system having a plurality of selectable weights as set forth in claim 1, wherein said incremental weight stack is supported by a stand.

7. An incremental weight system having a plurality of selectable weights as set forth in claim 1, wherein said selector plate is positionable so that it does not engage said incremental weight stack with any of said pins.

8. An incremental weight system having a plurality of selectable incremental weights, comprising:

an incremental weight stack having a plurality of incremental weights of similar weight, said incremental weight stack supported by a stand, each of said incremental weights defining a slot;

a selector plate having a number of pins equal to a total number of said incremental weights with each pin positioned to uniquely correspond to a single slot in a single one of said plurality of incremental weights on a one-to-one basis so that each pin has a uniquely corresponding incremental weight and incremental weight slot and vice versa, said selector plate positionable so that it does not engage said incremental weight stack with any of said pins;

said selector plate being proximate and adjacent said incremental weights so that said pins may selectably engage said slots, said selector plate being positionable so as to selectably and uniquely engage one or more of said incremental weights with a corresponding pin, said incremental weight stack offset a distance from a center of said selector plate;

each of said slots of said incremental weights disposed a different radial distance from said center of said selector plate with each of said pins also disposed a different radial distance from said center of said selector plate such that by displacing and turning said selector plate, individual ones of said incremental weights may be engaged by a corresponding pin which is passable through a corresponding slot;

a chassis adapted to engage a selector weight stack, said selector weight stack having a number of uniform weights;

a retaining plate;

a post slidably passing through said retaining plate and coupled at a distal end to said selector plate;

a biasing spring system biasing said post and said selector plate toward said incremental weight stack;

a handle coupled to the post;

said chassis, said retaining plate, said post, said biasing system, and said handle together weighing approximately the same as an individual one of said incremental weights; and each of said incremental weights weighing approximately one-fourth (¼) of the weight of one of said uniform weights of said selector weight stack.

9. In a selector weight system having a number of similar selectable weights, a selectable incremental weight system, comprising:

an incremental weight stack having a plurality of incremental weights of similar weight, said incremental weight stack supported by a stand, each of said incremental weights defining a slot;

a selector plate having a number of pins equal to a total number of said incremental weights with each pin positioned to uniquely correspond to a single slot in a single one of said plurality of incremental weights on a one-to-one basis so that each pin has a uniquely corresponding incremental weight and incremental weight slot and vice versa, said selector plate positionable so that it does not engage said incremental weight stack with any of said pins;

said selector plate being proximate and adjacent said incremental weights so that said pins may selectably engage said slots, said selector plate being positionable so as to selectably and uniquely engage one or more of said incremental weights with a corresponding pin, said incremental weight stack offset a distance from a center of said selector plate;

each of said slots of said incremental weights disposed a different radial distance from said center of said selector plate with each of said pins also disposed a different radial distance from said center of said selector plate such that by displacing and turning said selector plate, individual ones of said incremental weights may be engaged by a corresponding pin which is passable through a corresponding slot;

a chassis adapted to engage a selector weight stack, said selector weight stack having a number of uniform weights;

a retaining plate;

a post slidably passing through said retaining plate and coupled at a distal end to said selector plate;

a biasing spring system biasing said post and said selector plate toward said incremental weight stack;

a handle coupled to the post;

said chassis, said retaining plate, said post, said biasing system, and said handle together weighing approximately the same as an individual one of said incremental weights; and each of said incremental weights weighing approximately one-fourth (¼) of the weight of one of said uniform weights of said selector weight stack.

* * * * *